United States Patent [19]

Ground

[11] 4,199,348

[45] Apr. 22, 1980

[54] MINERAL ORE PELLETS

[75] Inventor: Ernest R. Ground, Coahuila, Mexico

[73] Assignee: International Minerals & Chemical Corporation, Northbrook, Ill.

[21] Appl. No.: 913,722

[22] Filed: Jun. 7, 1978

[51] Int. Cl.[2] ..... C22B 1/08

[52] U.S. Cl. ..... 75/3; 264/117; 264/122; 75/4; 75/5

[58] Field of Search ..... 264/117, 122; 75/3, 75/4, 5

[56] References Cited

U.S. PATENT DOCUMENTS

| | | | |
|---|---|---|---|
| 3,617,254 | 3/1969 | Imperato, Jr. | 75/3 |
| 3,816,094 | 6/1974 | Low et al. | 75/3 |
| 3,871,869 | 3/1975 | Overdijk | 75/3 |
| 4,116,681 | 9/1978 | Radstake et al. | 264/122 |

*Primary Examiner*—Donald J. Arnold
*Assistant Examiner*—James R. Hall

[57] ABSTRACT

Mineral ore pellets substantially devoid of water are disclosed which contain particles of mineral ore and an alkali metal carbonate. A method for making such pellets is also disclosed which includes mixing particulate mineral ore with an alkali metal carbonate and water to form a plastic mass, forming the plastic mass into pellets, and heating the pellets to drive off the water and provide relatively hard, moisture resistant pellets.

8 Claims, No Drawings

MINERAL ORE PELLETS

BACKGROUND OF THE INVENTION

This invention relates to mineral ore pellets. More particularly, it relates to mineral ore pellets prepared from finely divided mineral ores.

Certain mineral ores are encountered in a finely divided state, either because they so occur naturally or because they are reduced to such a state for beneficiation. Typical of the latter ores are fluorspar ($CaF_2$), olivine sand, taconite (a low grade iron ore), manganese and chrome ores, and mixtures thereof. The finely divided state of these ores may present difficulties, such as dusting or caking, in subsequent operations involving the ores.

Ores which are charged into metallurgical furnaces, such as taconite or fluorspar, present special difficulties if they are in a finely divided state, because they are often blown out through the furnace stack with the violent currents of gases present in such furnaces.

To overcome these difficulties, finely divided mineral ores are conventionally shaped into pellets, such as briquettes, balls, or various extruded forms. These various forms are intended to prevent dusting, crumbling, or caking of the ores and provide a free flowing, moisture resistant product which will resist being blown out of a blast furnace through the furnace stack. To insure that ore pellets have these qualities, yet are suitable for their intended purposes, it has been found that the pellets should be porous and uniformly hard throughout their structure. The pellets are preferably resistant to abrasion and impact so that fines are not formed during storage and handling, and, to allow outside storage, they are advantageously moisture resistant.

Heretofore, mineral ore pellets have been prepared by binding the ore particles with such materials as portland cement, bentonite clay, bentonite in combination with a soap, sodium silicate, organic resins, and related materials. Pellets prepared with such binders sometimes suffer from disadvantages. For instance, they may lack sufficient resistance to physical abrasion or impact or to moisture, or they may contain undesirable high concentrations of contaminating compounds, e.g. silica.

SUMMARY OF THE INVENTION

It is, therefore, an object of this invention to provide novel mineral ore pellets. Another object of the invention is to provide mineral ore pellets prepared from finely divided mineral ores. A further object is to provide mineral ore pellets which are porous, yet resistant to physical abrasion or impact or to moisture and which contain only low concentrations of contaminating compounds. Yet another object is to provide a method for producing mineral ore pellets of the present invention.

In accordance with the invention, there is provided a mineral ore pellet substantially devoid of uncombined water, comprising particulate mineral ore and a binding amount of an alkali metal carbonate. There is also provided a method for making mineral ore pellets, which comprises mixing particulate mineral ore with a binding amount of an alkali metal carbonate and a plasticizing amount of water to form a plastic mass, forming the plastic mass into pellets, and heating the pellets to a temperature sufficient to drive off substantially all of the uncombined water to provide relatively hard, moisture resistant pellets.

DETAILED DESCRIPTION OF THE INVENTION

The mineral ores used to prepare the pellets of the present invention are generally in a finely divided state. The ores may occur naturally in that state, but, more frequently, are reduced to a finely divided state for beneficiation. In the latter case, the ore concentrate, i.e. the upgraded particulate ore material, provides the starting material for the pellets of this invention. The ore particles may be of a size to pass about a 50 mesh screen, however, generally smaller particles, for instance, in the order of 100 mesh, are preferred, and ores containing about 50% or more of −325 mesh particles are most preferred. (Note the term mesh refers to standard Tyler mesh.)

The particulate mineral ore is mixed with a binding amount of an alkali metal carbonate. Such carbonates may be refined materials but, for economic reasons, are preferably technical grade products such as soda ash ($Na_2CO_3$), potash ($K_2CO_3$), and the like, with soda ash being most preferred because of its superior binding qualities.

A binding amount of an alkali metal carbonate is generally a concentration greater than about 0.5 wt % of the dry pellet. The maximum alkali metal carbonate concentration is largely determined by economics and by the purity of the mineral ore which is desired in the pellet. It has been found that amounts of alkali metal carbonate in the order of 10 wt % to 15 wt % of the dry pellet are acceptable. The preferred concentration is from about 1 wt % to about 5 wt %, most preferably about 3 wt %.

Water is added to the mixture in a plasticizing amount, i.e. in an amount sufficient to form a plastic mass with the consistency of a stiff mud which can be formed into the desired shape of pellets. The wet pellets (usually referred to as green pellets) should have sufficient strength (usually referred to as green strength) to withstand subsequent handling and storage prior to drying. The pellets made according to the present invention have been found to have been green strength. A plasticizing amount of water generally ranges from about 5 wt % to about 20 wt % of the wet mixture. Amounts of water lower than about 5 wt % are usually not sufficient to form a plastic mass, whereas amounts greater than about 20 wt % form wet, sticky pellets which have low green strengths. High water content also may cause the pellets to crack during subsequent drying steps. The preferred range of water concentration is from about 8 wt % to about 12 wt %. Frequently, a wet ore concentrate, e.g. a wet filter cake, is used as a starting material, in which case, the amount of water in the concentrate must be taken into account when determining the amount of plasticizing water to use.

The mixture may be mixed and formed into pellets by any suitable means. Such means are well known in the art. Thus, the plastic mass may be forced into molds to form briquettes, extruded into any of a variety of shapes, or may be admitted to a conventional disc pelletizer or rolling drum pelletizer to form seed pellets which are then enlarged to a desirable size as the balling operation continues.

The green pellets are dried and hardened by heating to a temperature sufficient high to drive off substantially all of the uncombined water. It has been found that heating the pellets to a red hot temperature of about 600°-900° C. produces good pellets. The pellets are advantageously heated slowly to allow the steam formed to gradually escape. After the maximum temperature has been reached, the pellets may be cooled rapidly.

The present invention produces high quality mineral ore pellets having good resistance to physical abrasion and impact and moisture resistance and having relatively low concentrations of contaminating compounds. In the case of fluorspar pellets, it has been found that when acid grade fluorspar is used, the present invention produces pellets containing about 94–95% $CaF_2$. Heretofore, such high quality fluorspar pellets have been unavailable.

The invention is further illustrated by the following examples which are not intended to be limiting.

EXAMPLE 1

This example describes the preparation of fluorspar ore briquettes suitable for use as a metallurgical flux. The material used to prepare the pellets was wet fluorspar ore filter cake containing about 10 wt % water. The ore had the following physical and chemical characteristics on a dry basis.

| | | |
|---|---|---|
| Particle size | plus 100 mesh | 3.6% |
| | minus 100 mesh plus 325 mesh | 46.6% |
| | minus 325 mesh | 49.8% |
| $CaF_2$ | 98.38% | |
| $CaCO_3$ | 0.90% | |
| $SiO_2$ | 0.18% | |

The filter cake was mixed with sufficient sodium carbonate in a rod mill to prepare a mixture containing about 3% sodium carbonate. The sodium carbonate containing mixture was then molded into green briquettes by placing the mixture in a mold about 5 centimeters in diameter and 2.5 centimeters deep and subjecting the material to a pressure of about 5500 kg. Dense hard green briquettes were obtained. The briquettes were divided into three groups and treated as follows:

Group 1—The briquettes were air dried at ambient temperature (27° C.) for 48 hours then placed in a furnace heated to about 700° C. for ten minutes. The resulting briquettes were dense, hard and free from cracks.

Group 2—The briquettes were dried at a temperature of about 150°-200° C. for thirty minutes to remove essentially all of the moisture. The dried briquettes were then placed in a furnace heated to about 700° C. for ten minutes. The resulting briquettes were dense, hard, and free from cracks.

Group 3—The briquettes were placed directly in a furnace heated to about 700° C. The resulting briquettes were dense and hard but showed some cracks caused by moisture escaping during firing.

EXAMPLE 2

This example described the preparation of fluorspar ore ball pellets suitable for use as a metallurgical flux. A fluorspar ore filter cake similar to that used in Example 1, except containing 12% water, was mixed with sufficient sodium carbonate in a rod mill to prepare a mixture containing about 3% sodium carbonate. The mixture was fed into a balling drum about 61 centimeters in diameter and 91 centimeters long. Pellets ranging from about 0.6 centimeter to about 1.25 centimeters were removed as formed. These pellets were dried for ten minutes at a temperature of about 150°-200° C. and then fired at a temperature of about 700° C. for five minutes. The pellets were dense, hard, and free from cracks.

EXAMPLE 3

A number of fluorspar ore pellets were prepared substantially according to the procedure described in Example 2, except the pellets had diameters in the range of from about 1.5 centimeters to about 2.1 centimeters. The pellets were subjected to the following described tests:

Crush Strength

The crush strength of a pellet was measured by placing the pellet between two flat plates of a pellet press equipped with means to gradually increase the pressure on the pellets between the two plates while indicating such pressure. The press was first loaded to a pressure of one pound, and the diameter of the pellet along the axis of compression was measured. The pressure was then increased gradually until the pellet was crushed. The pressure at which the pellet crushed is an indication of the pellet's crush strength. The following table indicates crush strength of the pellets of the present invention.

| Pellet Diameter (cm) | Crush Strength (kg) |
|---|---|
| 2.06 | 75 |
| 1.83 | 84 |
| 1.98 | 75 |
| 2.06 | 64 |
| 1.91 | 73 |
| 1.75 | 80 |
| 1.83 | 80 |

Abrasion Resistance

The effects of abrasion on the pellets were measured by placing fourteen pellets in a jar 19 centimeters in diameter and 18 centimeters long with four 0.33 centimeter ribs spaced evenly around the inside, and rotating the jar at 22 rpm. The initial weight of the pellets before tumbling was 152.58 g. After tumbling for 2.33 hours, the fines were blown from the jar, and the contents were re-weighed. The jar was rotated for another 2.33 hours and again the fines were blown from the jar and the contents re-weighed. The pellets lost 6.25 g after 2.33 hours of tumbling and 2.63 g after the second 2.33 hours for a total of 8.88 g after 4.66 hours. Despite the erosion of the original surface of the pellets, the surface after tumbling appeared as hard as the original.

Drop Test

Ten pellets were dropped, one at a time, from each of 91 centimeters, 183 centimeters, 274 centimeters and 366 centimeters above a hard floor. The number of pellets which broke upon impact with the floor was recorded.

| Height (cm) | Number Broken |
|---|---|
| 91 | 2 |
| 183 | 4 |
| 274 | 3 |
| 366 | 0 |

The most pertinent observation resulting from this test is that most of the pellets simply split in half or into a small number of relatively large pieces, rather than generating many small shards.

Water Submersion

Several pellets were submersed in water at 95° C. for a period of twenty-four hours. The pellets remained firm and strong and suffered no adverse effects on drying.

EXAMPLE 4

The experiment of Example 1 is repeated in all essential details except potassium carbonate is substituted for sodium carbonate. Strong, hard briquettes should be obtained.

EXAMPLE 5

The experiment of Example 1 is repeated in all essential details except finely divided wet (10% $H_2O$) taconite ore is substituted for fluorspar ore. Strong, hard taconite briquettes should be obtained.

EXAMPLE 6

The experiment of Example 1 is repeated in all essential details except finely divided wet (10% $H_2O$) manganese ore is substituted for fluorspar ore. Strong, hard manganese ore briquettes should be obtained.

EXAMPLE 7

The experiment of Example 1 is repeated in all essential details except finely divided wet (10% $H_2O$) chrome ore is substituted for fluorspar ore. Strong, hard chrome ore briquettes should be obtained.

I claim:

1. A mineral ore pellet substantially devoid of uncombined water, comprising particulate mineral ore and a binding amount of an alkali metal carbonate, said carbonate being present in a concentration of from about 0.5 wt.% to about 15 wt.% of the dry pellet.

2. The mineral ore pellet of claim 1 wherein the particulate mineral ore is selected from the group consisting of fluorspar, olivine sand, taconite, manganese ore, chrome ore, and mixtures thereof, and has a particle size of about 50 mesh or smaller.

3. The mineral ore pellet of claim 2 wherein the alkali metal carbonate is selected from the group consisting of soda ash and potash.

4. The mineral ore pellet of claim 1 wherein the particulate mineral ore is fluorspar and has a particle size of about 100 mesh or smaller and the alkali metal carbonate is soda ash and is present in the pellet at a concentration of from about 1 wt % to about 5 wt % of the dry pellet.

5. A method for making mineral ore pellets, which comprises mixing particulate mineral ore with a binding amount of an alkali metal carbonate, said carbonate being present in a concentration of from about 0.5 wt.% to about 15 wt.% of the dry pellet, and a plasticizing amount of water to form a plastic mass, forming the plastic mass into pellets to provide sufficient green strength to withstand subsequent handling, and heating the pellets to a temperature sufficient to drive off substantially all of the uncombined water to provide relatively hard, moisture resistant pellets.

6. The method of claim 5 wherein the particulate mineral ore is selected from the group consisting of fluorspar, taconite, manganese ore, and chrome ore, and has a particle size of about 50 mesh or smaller.

7. The method of claim 5 wherein the alkali metal carbonate is selected from the group consisting of soda ash and potash.

8. The method of claim 5 wherein the particulate mineral ore is fluorspar and has a particle size of about 100 mesh or smaller and the alkali metal carbonate is soda ash and is present in the pellet at a concentration of from about 1 wt % to about 5 wt % of the dry pellet.

* * * * *